US008425007B2

(12) United States Patent
Essen

(10) Patent No.: US 8,425,007 B2
(45) Date of Patent: Apr. 23, 2013

(54) ADJUSTABLE PRINTHEAD MOUNTING

(75) Inventor: Kevin von Essen, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 64 days.

(21) Appl. No.: 12/991,804

(22) PCT Filed: May 8, 2009

(86) PCT No.: PCT/US2009/043316

§ 371 (c)(1),
(2), (4) Date: Jan. 10, 2011

(87) PCT Pub. No.: WO2009/142927

PCT Pub. Date: Nov. 26, 2009

(65) Prior Publication Data

US 2011/0109696 A1 May 12, 2011

Related U.S. Application Data

(60) Provisional application No. 61/055,823, filed on May 23, 2008.

(51) Int. Cl.
*B41J 2/14* (2006.01)
*B41J 2/16* (2006.01)

(52) U.S. Cl.
USPC ..... 347/49; 347/20; 347/40

(58) Field of Classification Search ..... 347/40, 347/42, 43, 49
See application file for complete search history.

(56) References Cited

U.S. PATENT DOCUMENTS

| | | | |
|---|---|---|---|
| 4,353,078 | A | 10/1982 | Lee et al. |
| 4,825,227 | A | 4/1989 | Fischbeck et al. |
| 4,940,998 | A | 7/1990 | Asakawa |
| 5,887,987 | A | 3/1999 | Sawano |
| 5,964,541 | A | 10/1999 | Murison et al. |
| 6,068,367 | A | 5/2000 | Fabbri |

(Continued)

FOREIGN PATENT DOCUMENTS

| | | |
|---|---|---|
| EP | 1258354 | 11/2002 |
| WO | 2009/142927 | 11/2009 |

OTHER PUBLICATIONS

International Search Report and Written Opinion dated Jul. 2, 2009 issued in international application No. PCT/US2009/043316, 8 pgs.

(Continued)

*Primary Examiner* — Thinh Nguyen
(74) *Attorney, Agent, or Firm* — Fish & Richardson P.C.

(57) ABSTRACT

A system includes a mounting assembly to mount a printhead to a frame having a length in a first direction and a width in a second direction. The mounting assembly includes a fixed component affixed to the frame and a movable component that can move relative to the fixed component. A first pair of flexures connects a first end of the fixed component to a first end of the movable component, and a first adjustment mechanism is positioned at the first end. A second pair of flexures connects a second end of the fixed component to a second end of the movable component, and a second adjustment mechanism is positioned at the second end. A connector couples the mounting assembly to the printhead such that movement of the movable component imparts movement to the printhead. The first adjustment mechanism and the second adjustment mechanism can be operated individually or together.

14 Claims, 8 Drawing Sheets

U.S. PATENT DOCUMENTS

| | | | | |
|---|---|---|---|---|
| 6,095,701 | A | 8/2000 | Sattler | |
| 6,213,580 | B1 | 4/2001 | Segerstrom et al. | |
| 6,428,142 | B1 | 8/2002 | Silverbrook et al. | |
| 6,554,398 | B2 | 4/2003 | Wyngaert et al. | |
| 7,077,501 | B2 * | 7/2006 | Kitahara et al. | 347/40 |
| 7,413,284 | B2 | 8/2008 | Higginson et al. | |
| 2005/0280678 | A1 | 12/2005 | Bibl et al. | |

OTHER PUBLICATIONS

International Preliminary Report on Patentability dated Dec. 2, 2010 issued in International Application No. PCT/US2009/043316, 7 pgs.

* cited by examiner

ADJUSTABLE PRINTHEAD MOUNTING

CROSS-REFERENCE TO RELATED APPLICATIONS

This application is the national stage of International Application Number PCT/US2009/043316, entitled "Adjustable Printhead Mounting", filed on May 8, 2009, which is based on and claims the benefit of the filing date of U.S. Provisional Application No. 61/055,823, entitled "Adjustable Printhead Mounting", filed on May 23, 2008, both of which as filed are incorporated herein by reference in their entireties.

BACKGROUND

The following description relates to depositing fluid onto a medium. An ink jet printer typically includes an ink path from an ink supply to an ink nozzle assembly that includes nozzles from which ink drops are ejected. Ink drop ejection can be controlled by pressurizing ink in the ink path with an actuator, for example, a piezoelectric transducer, a thermal bubble jet generator, or an electrostatically deflected element. A typical printhead module has a line or an array of nozzles with a corresponding array of ink paths and associated actuators, and drop ejection from each nozzle can be independently controlled. In a so-called "drop-on-demand" printhead module, each actuator is fired to selectively eject a drop at a specific location on a medium. The printhead module and the medium can be moving relative one another during a printing operation.

In one example, a printhead module can include a substrate and an actuator. The substrate can include a flow path body, which can be made of silicon and can include microfabricated flow paths and pumping chambers. The substrate can also include a nozzle layer secured to the flow path body, and nozzle layer can include nozzles formed therein. The actuator can include a layer of piezoelectric material that changes geometry, or flexes, in response to an applied voltage. Flexing of the actuator pressurizes ink in a pumping chamber located along the ink path.

Printing accuracy can be influenced by a number of factors. Precisely positioning the nozzles relative to the medium can be necessary for precision printing. If multiple printhead modules are used to print contemporaneously, then precise alignment of the nozzles included in the printhead modules relative to one another also can be critical for precision printing.

SUMMARY

A mounting assembly for a fluid ejection module configured to deposit a fluid onto a medium is described. A system can include a mounting assembly to mount a fluid ejection module to a frame having a length in a first direction and a width in a second direction. The mounting assembly can include a fixed component configured to affix to the frame and a movable component adapted to move relative to the fixed component and the frame. The mounting assembly can also include a first pair of flexures connecting a first end of the fixed component to a first end of the movable component, a first adjustment mechanism positioned at the first end, a second pair of flexures connecting a second end of the fixed component to a second end of the movable component, and a second adjustment mechanism positioned at the second end. The mounting assembly can also include a connector configured to couple the mounting assembly to the fluid ejection module such that movement of the movable component imparts corresponding movement to the fluid ejection module. The first adjustment mechanism and the second adjustment mechanism are configured to be operated individually to rotate the first or second end of the movable component, respectively, and to be operated together to translate the movable component in an angular (non-zero) direction relative to the first direction and the second direction.

A system can include a frame having a length in a first direction and a width in a second direction. A system can also include a mounting assembly configured to mount a fluid ejection module to the frame. The mounting assembly can include a fixed component configured to affix to the frame, a movable component configured to move relative to the fixed component and the frame, and a first adjustment mechanism positioned along a first axis that is orthogonal to a first surface of the movable component and that is proximate to a first end of the movable component. The mounting assembly can also include a second adjustment mechanism positioned along a second axis that is orthogonal to the first surface of the movable component and that is proximate to a second end of the movable component. The mounting assembly can also include a connector configured to couple the mounting assembly to the fluid ejection module such that movement of the movable component imparts corresponding movement to the fluid ejection module. The first adjustment mechanism and the second adjustment mechanism can be configured to be operated individually to rotate the movable component about the second axis and the first axis, respectively, and are configured to be operated together to translate the movable component in an oblique angular direction relative to the first direction and the second direction.

Implementations can include one or more of the following features. A length of each flexure in the first and second pair of flexures can be identical such that the fixed component and the movable component remain substantially parallel to one another while moving relative to one another. The first adjustment mechanism can be positioned between the first pair of flexures and the second adjustment mechanism can be positioned between the second pair of flexures. A first edge of the fixed component, a first edge of the movable component, and the first pair of flexures can together foam a parallelogram configuration that is substantially maintained upon movement of the movable component. A second edge of the fixed component, a second edge of the movable component, and a second pair of flexures can together also faun a parallelogram configuration that is substantially maintained upon movement of the movable component.

The fluid ejection module can have a width in a third direction and include an array of nozzles formed on a nozzle face. The first adjustment mechanism and the second adjustment mechanism can be configured to operate individually to rotate a first or second end of the fluid ejection module, respectively, and to operate together to translate the fluid ejection module in the third direction such that the array of nozzles can be aligned relative to the frame and relative to an array of nozzles included in an adjacent fluid ejection module also mounted to the frame.

At least one of the first adjustment mechanism and the second adjustment mechanism can include an eccentric bearing. The eccentric bearing can be configured such that operating a corresponding adjustment mechanism can cause the eccentric bearing to at least partially orbit an axis through a center of the corresponding adjustment mechanism, the axis being substantially perpendicular to the fixed component. A system including a mounting assembly can also include a motor connected to at least one of the first adjustment mechanism and the second adjustment mechanism. The motor can be connected to one of the first adjustment mechanism or the second adjustment mechanism by reduction gears. A mounting assembly can also include a fluid inlet providing a fluid path through the fixed component and the movable component toward the fluid ejection module.

Implementations of this disclosure can realize none, some, or all of the following advantages. The use of two pairs of flexures in a mounting assembly can maintain a nozzle face parallel to the fixed component, thereby facilitating accurate alignment of the nozzle face. Use of an eccentric bearing offset from a screw axis permits relatively large angular movements to produce relatively small translations, thereby facilitating accuracy of alignment. Further, translating the nozzle face at an oblique angle relative to a desired adjustment direction increases accuracy of adjustment because a relatively large translation produces a relatively small adjustment in the desired adjustment direction. Use of two adjustment mechanisms permits adjustment of the fluid ejection module by both translation and rotation.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A fluid ejection module and a mounting assembly for the fluid ejection module are described. An exemplary fluid deposited by the fluid ejection module is ink. However, it should be understood that other fluids can be used, for example, electroluminescent material used in the manufacture of light emitting displays, liquid metals used in circuit board fabrication, or biological fluid.

A mounting assembly to mount a fluid ejection module to a frame is described. The frame is configured to position and support one or more fluid ejection modules near a medium. The mounting assembly includes a fixed component, which is configured to affix to the frame, and a movable component. The movable component is adapted to move relative to the fixed component and the frame, whereas the fixed component does not move relative to the frame. The fixed component and the movable component are connected by a first and a second pair of flexures. The first pair of flexures connects a first end of the fixed component to a first end of the movable component and the second pair of flexures connects a second end of the fixed component to a second end of the movable component. A first adjustment mechanism is positioned at the first end, for example, between the first pair of flexures, and a second adjustment mechanism is positioned at the second end, for example, between the second pair of flexures. The mounting assembly further includes a connector configured to couple the mounting assembly to the fluid ejection module.

Movement of the movable component imparts corresponding movement to the fluid ejection module. For example, the first adjustment mechanism and the second adjustment mechanism can be operated individually to rotate the first end or second end of the movable component, respectively. When the movable component rotates, the fluid ejection module also rotates. The frame has a length in an x direction and a width in a y direction. In one implementation, the first and second adjustment mechanism can be operated together to translate the movable component in an angular direction relative to the x and y directions. Similarly, when the movable component translates in a direction, the fluid ejection module also translates. In this manner, an array of nozzles included on a nozzle face of the fluid ejection module can be aligned to the frame and/or to an adjacent fluid ejection module also coupled to the frame, as shall be described in further detail below.

Figure 1A:
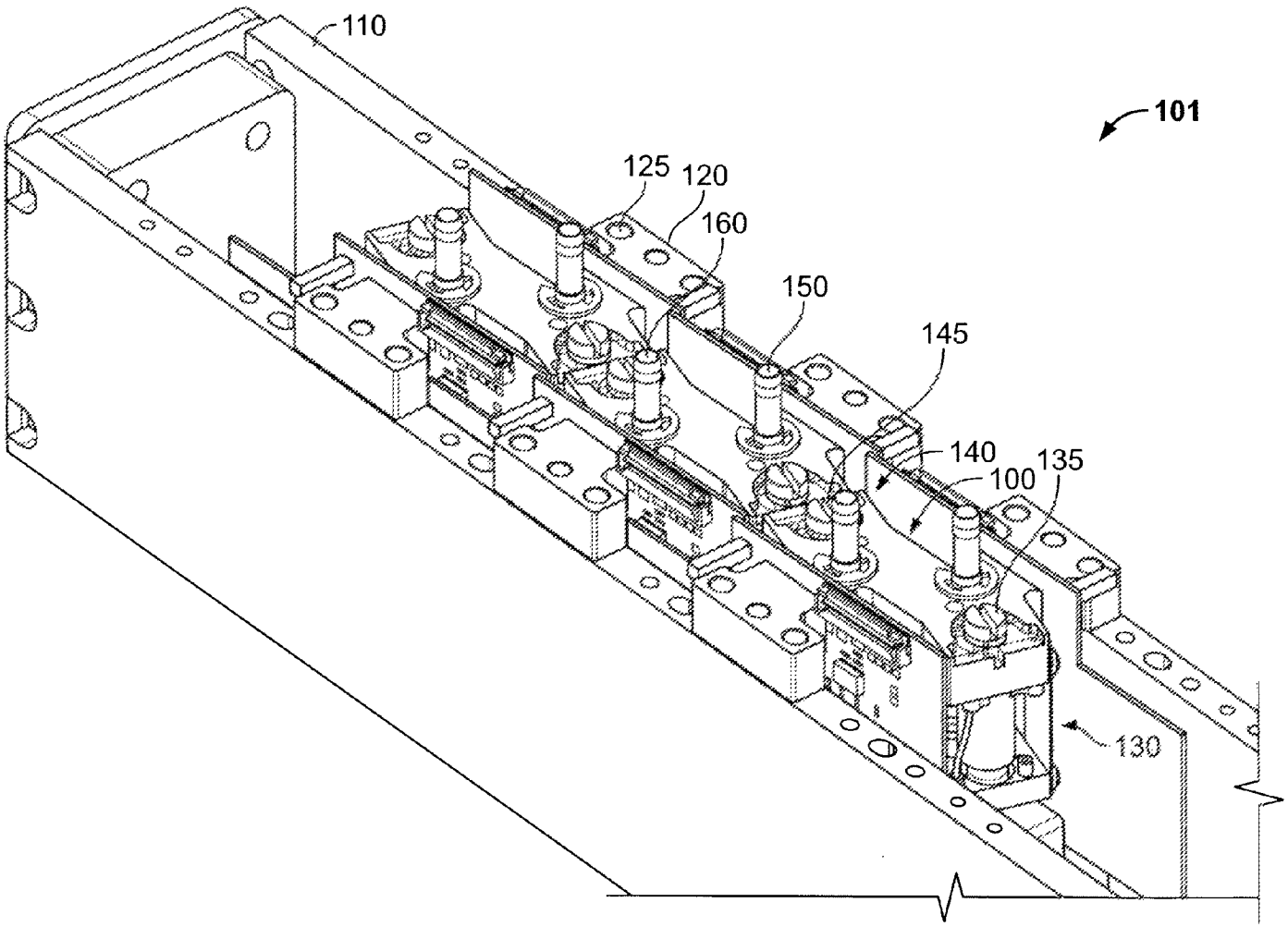
FIG. 1A is a perspective view of a printing apparatus including multiple example mounting assemblies mounting multiple fluid ejection modules to a frame.

FIG. 1A is a perspective view of a printing apparatus 101 including an implementation of multiple mounting assemblies 100 arranged within a frame 110. Each mounting assembly 100 is configured to mount a fluid ejection module to the frame 110. The mounting assemblies 100 include fixed components 120 that affix to the frame 110. In the implementation shown, each fixed component 120 includes apertures 125 configured to receive a connector (e.g., a screw) for fastening the fixed components 120 to the frame 110. The frame 110 includes bores 115 that align with the apertures 125 of the fixed component 120. Other techniques to affix the fixed components 120 to the frame 110 can be used, and the one described is but one example.

Each mounting assembly 100 can include a first adjustment mechanism 130 and a second adjustment mechanism 140. In the particular implementation shown, the first adjustment mechanism 130 includes a first adjustment screw 135, and the second adjustment mechanism 140 includes a second adjustment screw 145. The adjustment screws 135, 145 can be configured so as to be accessible from above each mounting assembly 100. Each mounting assembly 100 can include a fluid inlet 150 and a fluid outlet 160, which are discussed in more detail below.

Figure 1B:
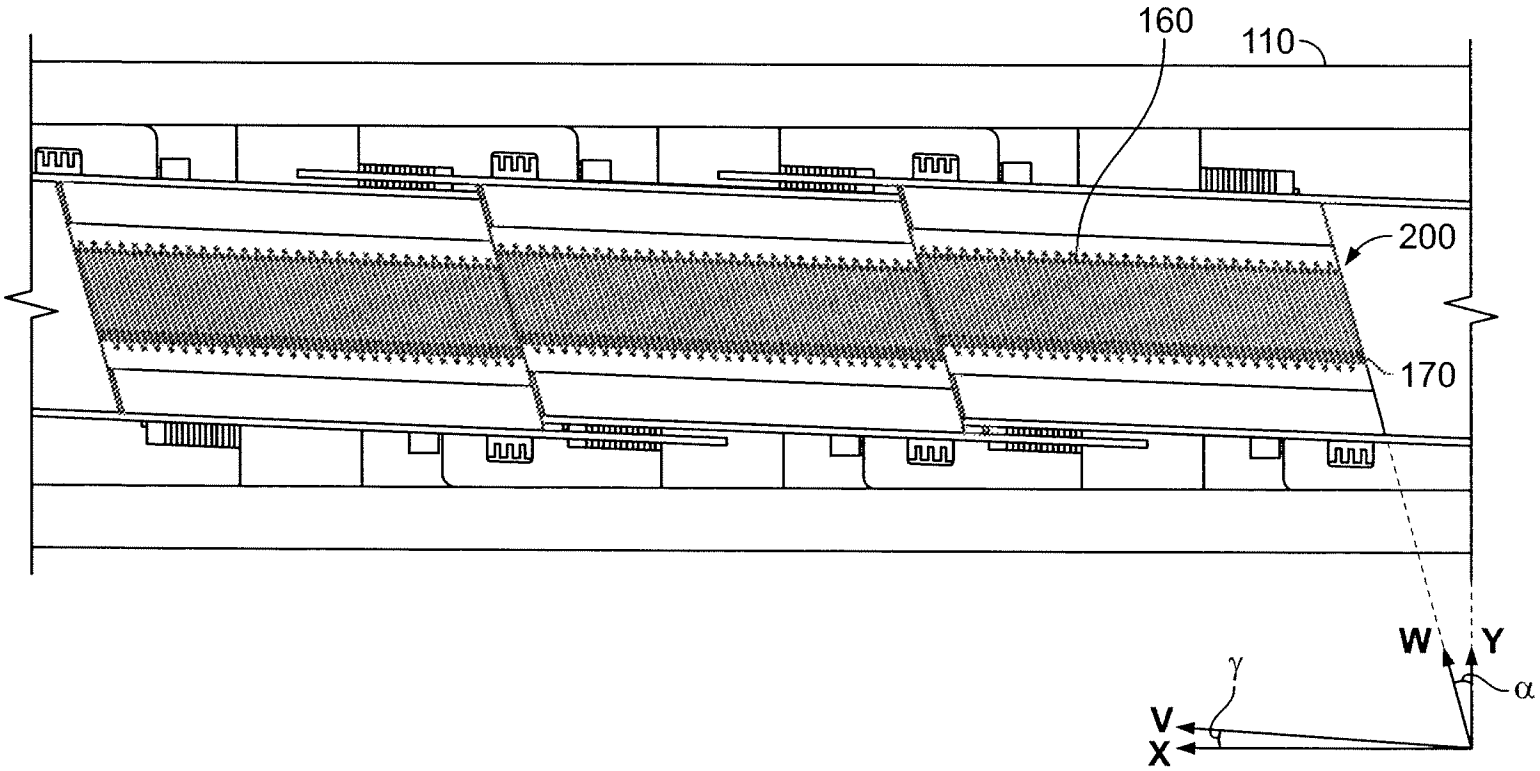
FIG. 1B is a planar bottom view of the printing apparatus shown in FIG. 1A.

FIG. 1B is a planar view of the bottom of the printing apparatus 101 shown in FIG. 1A. The nozzle faces 160 of the fluid ejection modules 200 mounted in the frame 110 by the mounting assemblies 100 are shown. In the implementation shown, each nozzle face 160 includes nozzles 170 arranged in columns forming a 2-D array of nozzles. In one particular example, each nozzle face 160 includes 64 columns with 32 nozzles per column, for a total of 2048 nozzles. In this implementation, the short edges of the nozzle faces 160 are at an angle (e.g., an oblique angle) relative to the frame 110, e.g., angle $\alpha$. That is, the width of the nozzle faces 160 extends in the w direction, whereas the width of the frame 110 extends in the y direction, as is illustrated in the vector diagram. Similarly, the long edges of the nozzle faces 160 are at an angle (e.g., an oblique angle) relative to the frame 110, e.g., angle $\gamma$. That is, the length of the nozzle faces 160 extends in the v direction, whereas the width of the frame 110 extends in the x direction. A medium upon which a fluid would be deposited by the fluid ejection modules 200 would, in one implementation, be positioned square to the frame 110, i.e., having edges aligned in the x and y directions.

Figure 2:
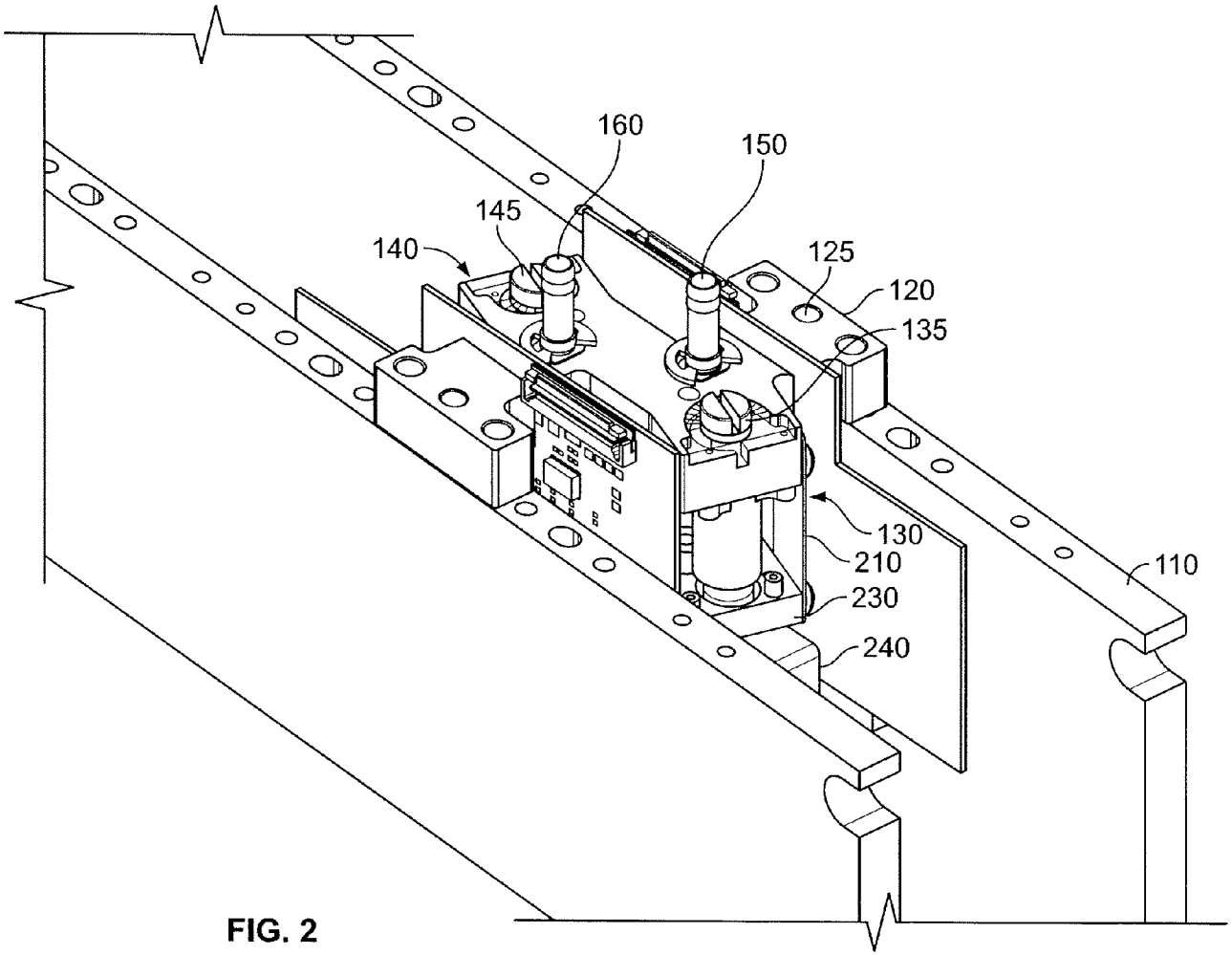
FIG. 2 is a perspective view of an example mounting assembly mounting a fluid ejection module to a frame.
Figure 3:
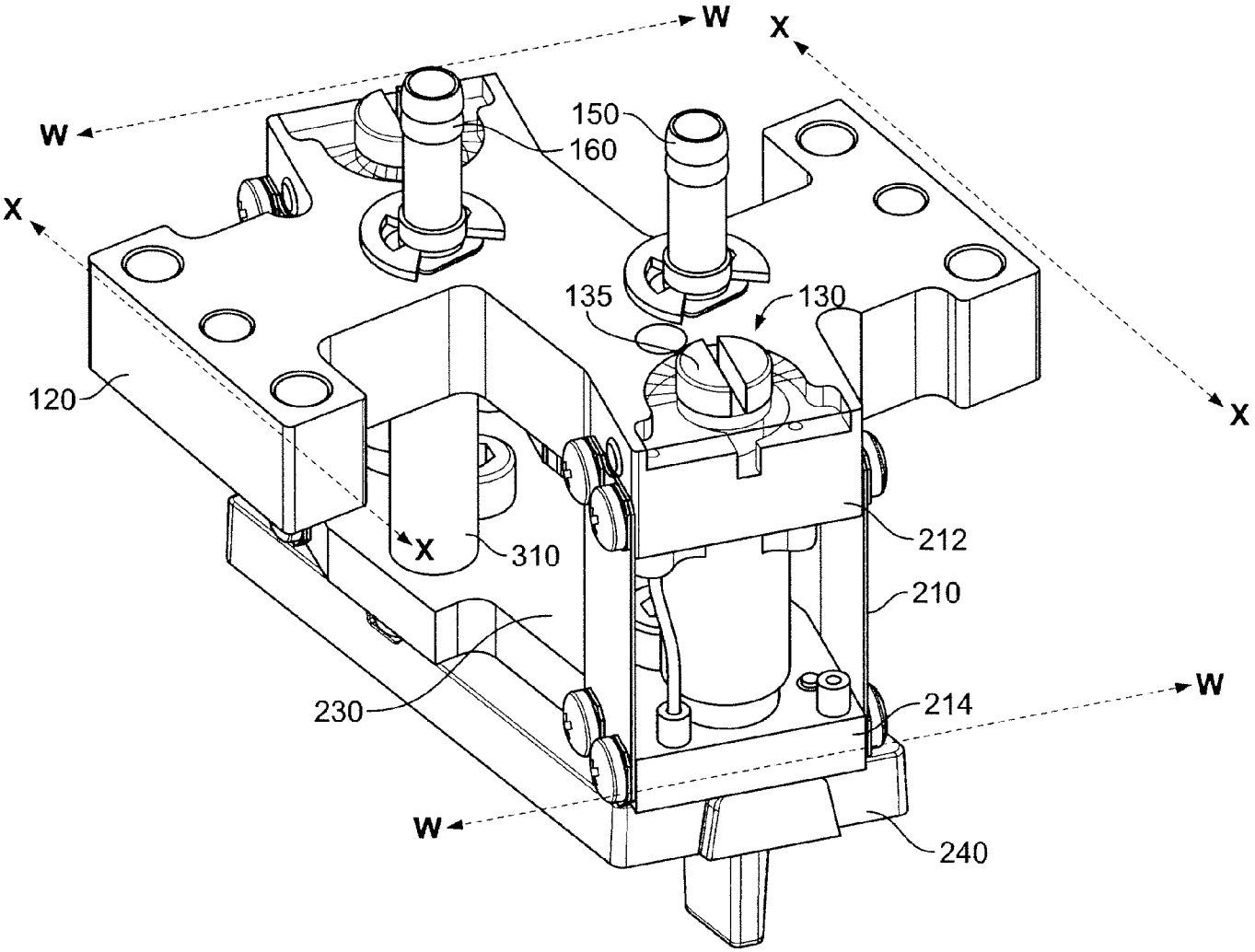
FIG. 3 is a perspective view of the example mounting assembly shown in FIG. 2.

Referring now to FIGS. 2 and 3, the mounting assembly 100 shall be described in further detail. For illustrative purposes, FIG. 2 is a perspective view of an a single fluid ejection module 200 mounted in the frame 110 by the mounting assembly 100. FIG. 3 shows the mounting assembly 100 in isolation.

The fluid inlet 150 and the fluid outlet 160 are configured for carrying fluid to and from, respectively, the fluid ejection module 200. The fluid inlet 150 can be fitted with a fluid supply tube (not shown), and the fluid outlet 160 can be fitted with a fluid return tube (not shown). In one example, the fluid supply tube and the fluid return tube can be made of an elastomeric rubber or other flexible material.

A first pair of flexures 210 and a second pair of flexures 220 (FIG. 4) connect the fixed component 120 to a movable component 230. The movable component 230 is configured or adapted to move relative to the frame 110 and/or the fixed component 120. The movable component 230 is also configured or adapted to effect movement of the fluid ejection module 200. In the example shown, each flexure is of substantially an identical length, such that the fixed component and movable component maintain a substantially parallel relationship to one another. In the implementation shown, the first adjustment mechanism 130 controls movement of the movable component 230 by manipulation of the first adjustment screw 135, and the second adjustment mechanism 140 controls movement of the movable component 230 by manipulation of the second adjustment screw 145. The first adjustment mechanism 130 and the second adjustment mechanism 140 can be positioned at opposite ends of the fixed component 120. In this implementation, the first adjustment mechanism 130 and the second adjustment mechanism 140 are positioned between the first pair of flexures 210 and the second pair of flexures 220, respectively. Alternatively, the adjustment mechanisms 130, 140 can be positioned alongside the pairs of flexures 210, 220 or elsewhere. A connector 240 attached to a bottom surface of the movable component 230 can connect the mounting assembly 100 to the fluid ejection module 200. In the implementation shown, a printhead mounting screw 235 secures the connector 240 to the movable component 230, although other techniques to affix the connector 240 can be used. In one implementation, the connector 240 can be formed integral to the movable component 230.

As is shown most clearly in FIG. 3, the first pair of flexures 210, an edge 212 of the fixed component 120, and an edge 214 of the movable component 230 form a parallelogram configuration. The second pair of flexures 220, an edge of the fixed component 120, and an edge of the movable component 230 also form a parallelogram configuration. The parallelogram configuration allows the movable component 230 to move relative to the fixed component 120 while remaining substantially parallel to the fixed component 120. Advantageously, the connector 240, fluid ejection module 200, and more importantly the nozzle face 160 also remain substantially parallel to the fixed component, and therefore substantially parallel to the medium upon which a printing fluid is to be deposited. It can be important to maintain the distance between the nozzle face and the medium substantially constant as well as consistent across the nozzle face 160.

In the implementation shown, the first pair of flexures 210 and the second pair of flexures 220 are oriented at an angle (e.g., an oblique angle) relative to the frame 110. In particular, the face of each parallelogram is oriented in the w direction, that is, parallel to the short edges of the nozzle face 160 (see FIG. 1B). In this implementation, the first pair of flexures 210 and the second pair of flexures 220 are arranged at the same angle relative to the frame 110. Orienting the pairs of flexures 210, 220 in this manner can allow the movable component 230 to translate in the w direction when both adjustment mechanisms 130, 140 are adjusted in the same direction by the same amount.

In some implementations, the flexures can be formed from thin sheets of material with a high modulus of elasticity and a high yield strength. For example, the flexures can be composed of a plain carbon steel, a spring steel, a stainless steel, or other suitable material. If one adjustment mechanism is rotated while the other remains stationary, the flexures of the stationary mechanism may undergo some twisting, however, the fixed component 120 and the movable component 230 will remain substantially parallel to one another.

In the implementation shown, a fluid supply tube 250 is fitted to the fluid inlet 150, and a fluid return tube 260 is fitted to the fluid outlet 160. A connector tube 310 is arranged between the fluid outlet 160 and the movable component 230. In some implementations, the connector tube 310 passes through the moveable component 230 and allows fluid to flow from the fluid ejection module 200 to the fluid outlet 160. Alternatively, the connector tube 310 can be arranged between the fluid outlet 160 and a fluid passage in the movable component 230. Another connector tube (not shown) can be provided between the fluid inlet 150 and the movable component 230. The connector tube 310 can be made of an elastomeric rubber or other flexible material to allow the movable component 230 to move relative to the fixed component 120 without disrupting the fluid connection of connector tube 310.

Figure 4:
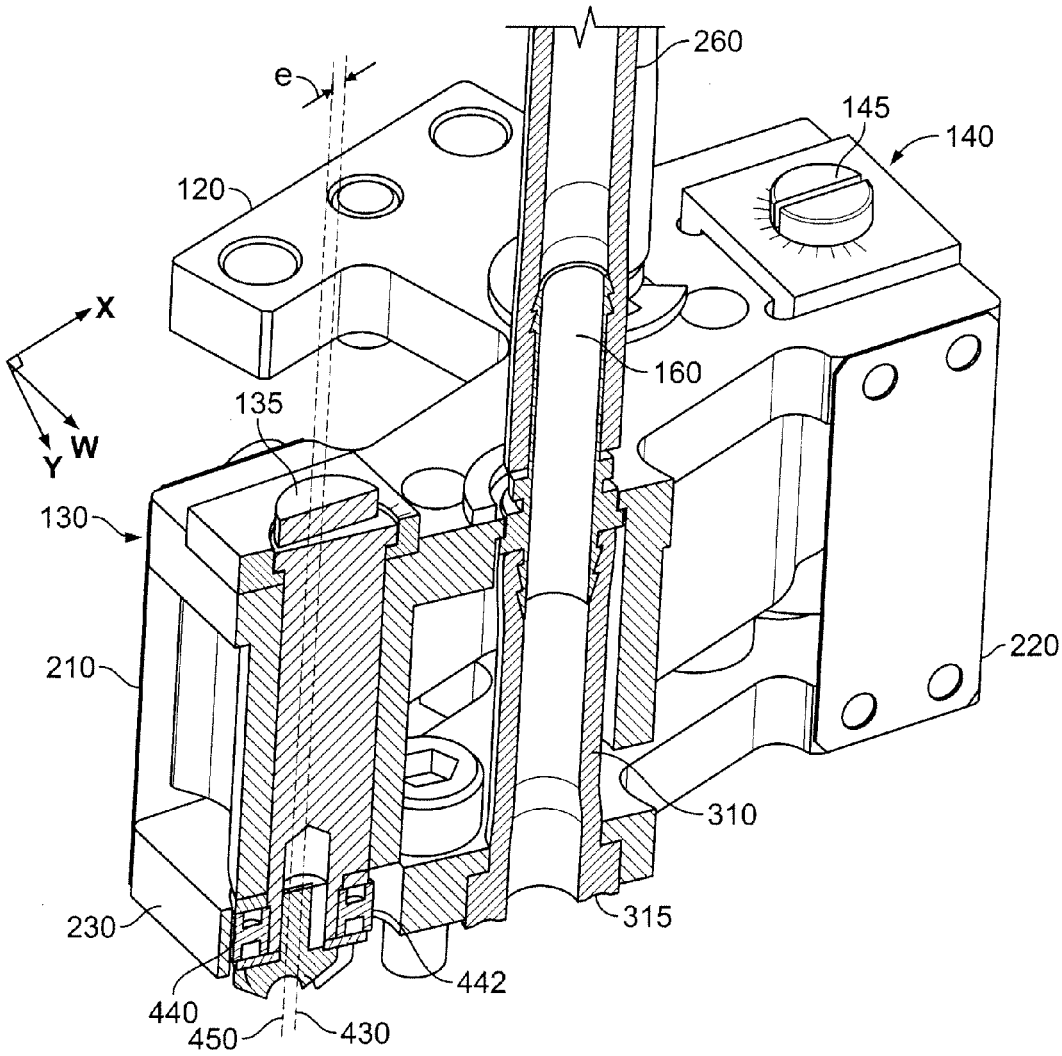
FIG. 4 is a partial cross-sectional view of the mounting assembly shown in FIG. 3.

FIG. 4 is a perspective, cross-sectional view of the implementation of the mounting assembly 100 shown in FIG. 3, rotated relative to the view shown in FIG. 3. The first adjustment mechanism 130 and surrounding components are shown in cross-section. The connector tube 310 has a connector tube bottom surface 315 that interfaces with the connector 240. The compressive force applied by the printhead mounting screw 235 can effect a fluid-tight compression seal between the connector tube bottom surface 315 and the connector 240. Alternatively, in implementations where the connector tube 310 does not pass through the movable component 230, the bottom surface of the movable component 230 can form a fluid-tight compression seal against the connector 240.

The first adjustment screw 135 has a screw axis 430 oriented longitudinally and located at the center of the first adjustment screw 135; the first adjustment screw 135 rotates about the screw axis 430. The first adjustment mechanism 130 includes an eccentric bearing 440 having an eccentric bearing axis 450 located at its center and oriented parallel with the screw axis 430. The eccentric bearing 440 also rotates about the screw axis 430. That is, the eccentric bearing 440 rotates about an axis that is offset from the eccentric bearing's center axis (i.e., eccentric bearing axis 450), and the eccentric bearing 440 can also orbit around the screw axis 430. The eccentric bearing 440 is mounted to the lower end of the first adjustment screw 135. The distance between the screw axis 430 and the eccentric bearing axis 450 is the offset amount "e". The offset e can also be referred to as an eccentricity e.

Because the eccentric bearing 430 is mounted relative to the first adjustment screw 135 in an offset manner, manipulation of the first adjustment screw 135 causes the eccentric bearing axis 450 to orbit the screw axis 430, as is further described below. The eccentric bearing 440 is positioned in a bore 442 in the movable component 230. As the eccentric bearing 440 orbits about the screw axis 430, the exterior surface of the bearing 440 exerts pressure against the interior surface of the bore 442, thereby moving the movable component 230. The distance between the screw axis 430 and the eccentric bearing axis 450 determines the range of relative motion between the fixed component 120 and the movable component 230. In other implementations, the bore 442 can be configured as a slot or gap between two surfaces of the movable component 230 and does not necessarily have to be configured as a bore, per se.

Figure 5A:
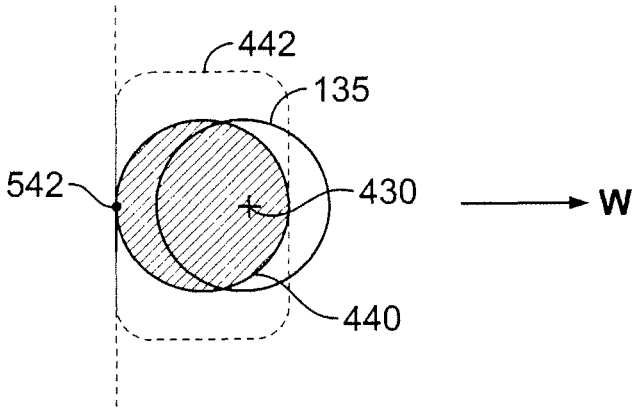
FIGS. 5A-C are schematic representations showing the relative positions of an adjustment screw and an eccentric bearing.
Figure 5B:
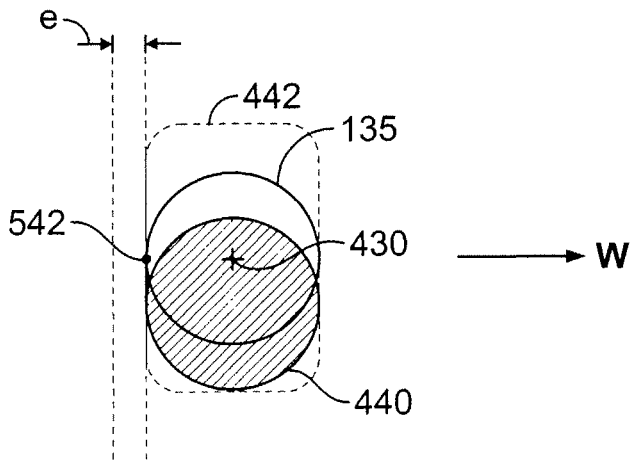
Figure 5C:
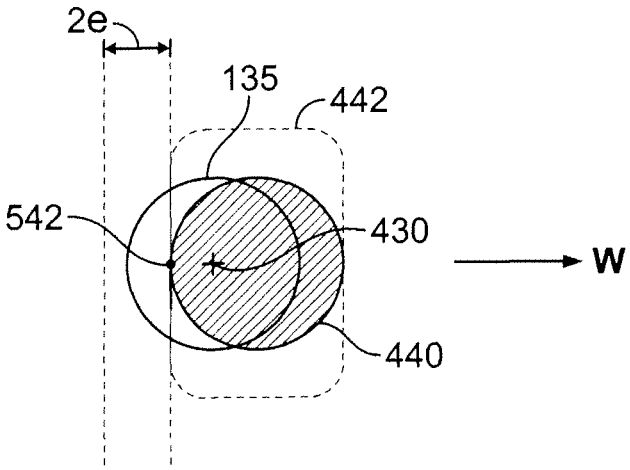

FIGS. 5A, 5B, and 5C are schematic representations showing the relative movement of the eccentric bearing 440 about the adjustment screw 135. The perimeter of the bore 442 is shown as a broken line. The bore 442 is configured such that movement is imparted to the inner surface of the bore 442, and therefore to the movable component 230, in the w direction only. However, in other configurations, movement in more than one direction can be accomplished by changing the configuration of the bore 442. To achieve movement in only the w direction, the bore 442 is configured such that the inner surface of the bore 442 contacts the exterior surface of the eccentric bearing 440 at two opposing points across the diameter of the bearing 440.

The screw axis 430 of the adjustment screw 135 is shown, which is also the axis of rotation of both the adjustment screw 135 and the eccentric bearing 440. A contact point 542 between the inner surface of the bore 442 and the exterior surface of the eccentric bearing 440 is shown. In FIG. 5A, the contact point 542 is at its leftmost position in terms of the w axis. As the eccentric bearing 440 rotates counter-clockwise about the screw axis 430, the contact point 542 moves toward the right in the w direction. FIG. 5B shows the position of the eccentric bearing 440 when the first adjustment screw 135 has been rotated 90 degrees counter-clockwise relative to its position in FIG. 5A. The contact point 542 has moved in the w direction by a distance equal to the offset e.

FIG. 5C shows the position of the eccentric bearing 440 when the first adjustment screw 135 has been rotated 90 degrees counter-clockwise relative to its position in FIG. 5B. The contact point 542 has again moved in the w direction by a distance equal to the offset e. The total displacement of the contact point 542 between the position in FIG. 5A and the position in FIG. 5C is equal to 2e in the w direction. This is the right-most position of the contact point 542. The contact point 542 will begin to translate back toward the left in the w direction as the eccentric bearing 440 continues to rotate counter-clockwise about the screw axis 430. That is, a half-turn of the adjustment screw 135 translates the contact point 542 by its maximum displacement of 2e. As an example, the distance 2e can be between about 1 micron and about 1000 microns, such as about 200 microns, although other distances are possible depending on the implementation.

Figure 6:
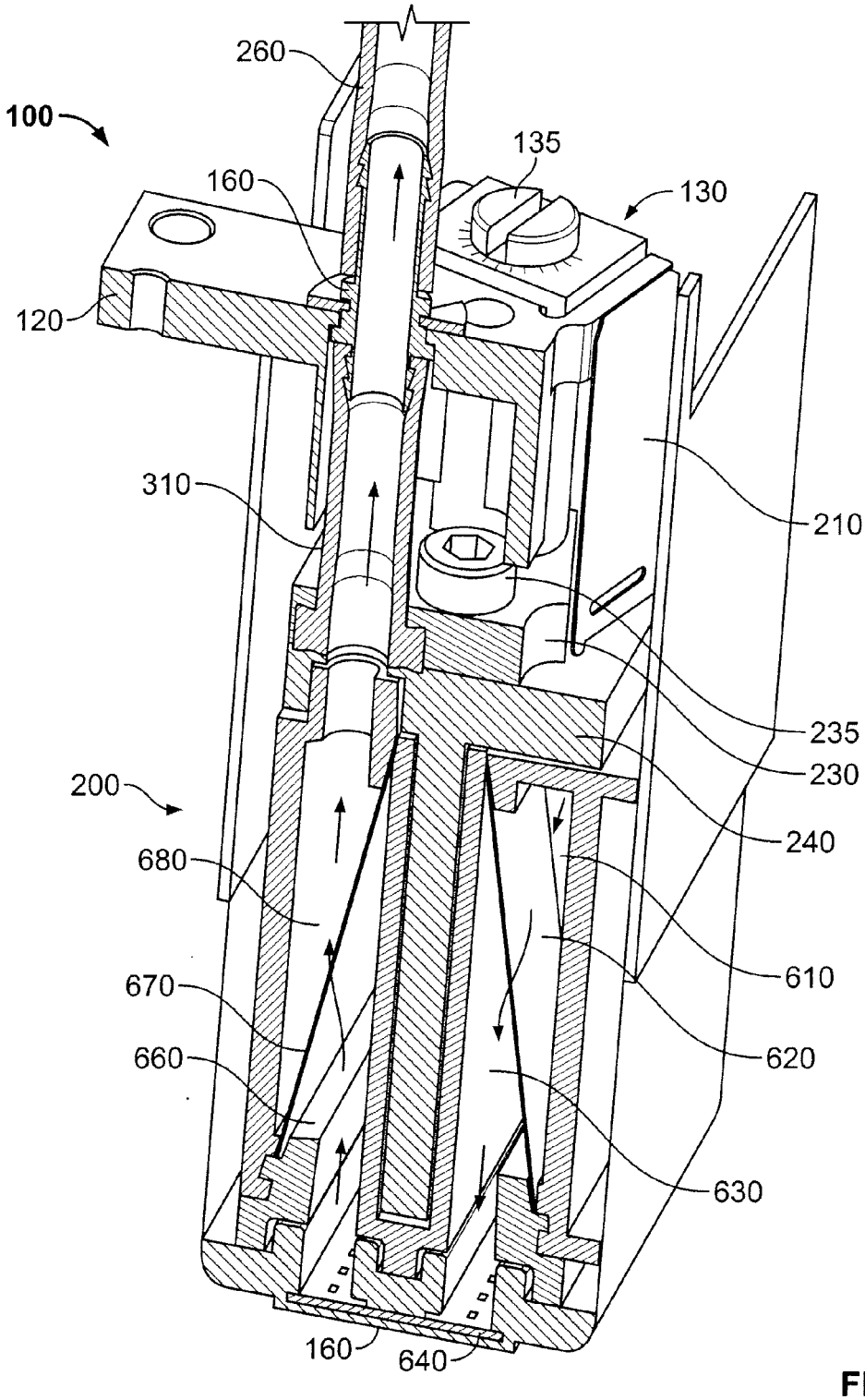
FIG. 6 is a cross-sectional view of an example fluid ejection module and the example mounting assembly.

FIG. 6 is a perspective, cross-sectional view of an implementation of the mounting assembly 100 attached to the fluid ejection module 200. The fluid ejection module 200 is but one example of a fluid ejection module 200 that can be mounted to the frame 110 by way of the mounting assembly 100. Other configurations of fluid ejection modules can also be mounted to the frame 110 using the mounting assembly 100. For illustrative purposes, the example fluid ejection module 200 is described in further detail below.

Fluid can enter an upper supply chamber 610 of the fluid ejection module 200 from the fluid inlet 150. Fluid can pass from the upper supply chamber 610 through a supply filter 620 into a lower supply chamber 630. From the lower supply chamber 630, fluid can pass through an interposer 640 into a substrate 160, which can be composed of silicon. The substrate 160 can include a fluid passage or multiple passages and at least one nozzle 170, as shown in FIG. 1B, described above. In some implementations, the fluid passage or passages can be microfabricated. Fluid that is not ejected through any of the nozzles 170 can exit the substrate 160 into lower return chamber 660. Fluid can pass from the lower return chamber 660 through a return filter 670 (optionally) and into an upper return chamber 680. Fluid can pass from the upper return chamber 680 through connector 240 and connector tube 310 into fluid outlet 160 and through fluid return tube 260.

In some implementations, a portion of the fluid passing through the fluid ejection module does not enter the substrate 160, but instead can bypass the substrate 160 and pass directly from the lower supply chamber 630 to the lower return chamber 660. This bypass flow can facilitate a higher overall flow rate of fluid through the fluid ejection module 200, which can, for example, remove contaminants from the fluid ejection module 200 and facilitate temperature control of the fluid ejection module 200.

The fluid ejection module 200 can include a plurality of actuators to cause fluid to be selectively ejected from each of the fluid passages. That is, a flow path from each fluid passage to a corresponding nozzle can be associated with an actuator that provides an individually controllable MEMS fluid ejector. The substrate 160 can include a flow-path body, a nozzle layer and a membrane layer. The flow-path body, nozzle layer and membrane layer can each be silicon, e.g., single crystal silicon. The fluid flow path can include a fluid inlet, an ascender, a pumping chamber adjacent the membrane layer, and a descender that terminates in a nozzle formed through the nozzle layer. Activation of the actuator causes the membrane to deflect into the pumping chamber, forcing fluid out of the nozzle.

Figure 7A:
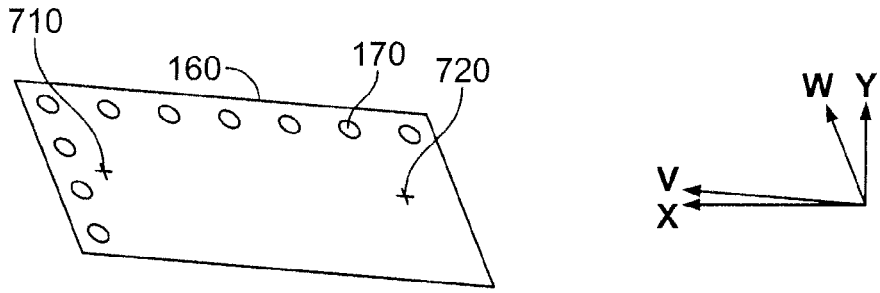
FIGS. 7A-C are schematic representations showing movement of a nozzle face included in a fluid ejection module.
Figure 7B:
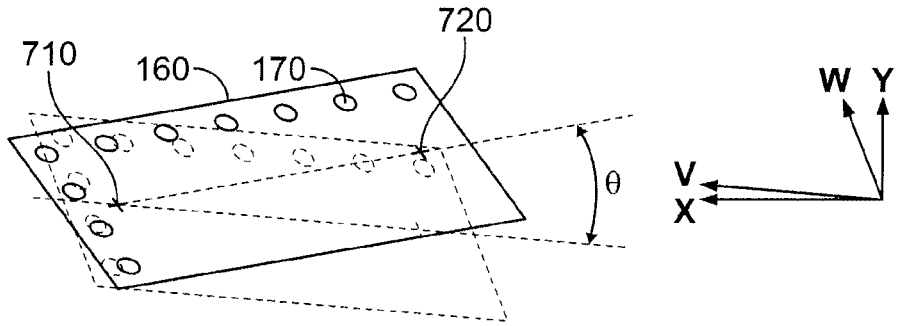
Figure 7C:
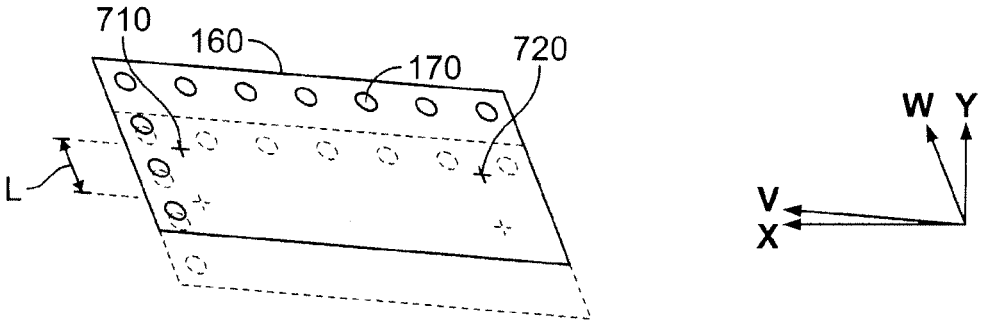

FIGS. 7A, 7B, and 7C are schematic representations of one of the nozzle faces 160 of one of the fluid ejection modules 200 shown in FIG. 1B. FIG. 7A shows a nozzle face 160 in a starting position. The nozzle face 160 has nozzles 170. Starting positions of a first bearing axis 710 and a second bearing axis 720 are marked near opposite ends of the nozzle face 160. Each of FIGS. 7A, 7B, and 7C has a vector diagram showing x, y, v, and w directions. The x and y directions are parallel and perpendicular to the length of the frame 110, respectively. The v and w directions are parallel with the long edges and short edges, respectively, of the nozzle face 160.

Angular misalignment of a nozzle face 160 can result in printing defects because fluid droplets may not be deposited in intended positions in the x direction, the y direction, or both. Misalignment can result from one or more fluid ejection modules being mounted at an incorrect angle relative to the frame 110, or from deformities in the frame 110, or from other causes. One or both of the first adjustment mechanism 130 and the second adjustment mechanism 140 can be adjusted to rotate or translate the nozzle face 160.

Referring to FIG. 7B, the starting position of the nozzle face 160 is shown in broken lines. An adjusted position of the nozzle face 160 is shown in solid lines. This adjusted position can be achieved by adjusting the second adjustment mechanism 140 to move the second end of the movable component 230, while keeping the first end of the movable component fixed, i.e., the first adjustment mechanism 130 is kept fixed. By only adjusting the second end of the movable component 230, the corresponding end of the nozzle face 160 rotates slightly about the first end, i.e., about the first bearing axis 710 by an angle θ relative to the starting position of the nozzle face 160. The relative movement is shown in an exaggerated manner in FIG. 7B to illustrate the relative movement. Because the fixed component 120 remains parallel to the movable component 230, the rotation can occur, in some implementations, because of some twisting of the flexures 220. Adjustments of this kind can be used to correct angular misalignment of the nozzle face 160 and/or to achieve translation in the x and y directions, as any rotation in the θ direction achieves some translation in the x and the y directions.

The y direction is the direction of travel of the medium on which fluid is deposited by a fluid ejection module 200. Incorrect positioning of a nozzle face 160 in the y direction can result in incorrect droplet deposition. Inconsistent (e.g., non-uniform) positioning of nozzles 170 in the y direction between multiple fluid ejection modules 200 can be corrected by controlling the relative timing of ejection of fluid from the nozzles 170. Thus, if the nozzles 170 of a first fluid ejection module 200 are offset by a certain distance in the y direction relative to the nozzles 170 of a second fluid ejection module 200, then the time at which the nozzles 170 of the second fluid ejection module 200 eject fluid can be advanced or delayed such that all of the nozzles 170 will deposit fluid on the medium in desired positions in the y direction. Alternatively, the first adjustment mechanism 130 and the second adjustment mechanism 140 can be adjusted to move one or more of the fluid ejection modules 200 to align the nozzles 170 in the y direction.

Incorrect positioning of a nozzle face 160 in the x direction can cause visible printing errors, e.g., streaks or lines on the medium. These printing errors cannot be corrected by adjusting the timing of fluid ejection from the nozzles on different fluid ejection modules 200 because the medium moves in the perpendicular y direction. The first adjustment mechanism 130 and the second adjustment mechanism 140 corresponding to a fluid ejection module 200 can be adjusted to translate the movable component 230 and with it the fluid ejection module 200. This translation occurs in a w direction, shown in FIG. 1B, and this translation has a component in the x direction and a component in the y direction.

Referring to FIG. 7C, a starting position of the nozzle face 160 is shown in broken lines. An adjusted position of the nozzle face 160 is shown in solid lines. When the first adjustment mechanism 130 and the second adjustment mechanism 140 are adjusted in the same direction by an equal amount, the nozzle face 160 translates in the w direction. A translation in the w direction produces a translation in the y direction and a translation in the x direction. Because a translation in the w direction produces a relatively smaller translation in the x direction, greater accuracy of translation can thus be obtained than if the movable component 230 were adjusted in the x direction directly. The flexures 210, 220 can be oriented such that translation in the w direction produces a greater translation in the y direction than in the x direction. In such a configuration, accuracy of adjustment in the x direction can be further improved. In some implementations, the translation in the y direction can be compensated for (e.g., canceled out) by adjusting the timing of fluid ejection, relative to translation of the medium, such that adjustment in the w direction only results in adjustment in the x direction.

Adjustments more complex than those shown in FIGS. 7A, 7B, and 7C are possible. For example, if the first adjustment mechanism 130 and the second adjustment mechanism 140 are adjusted by unequal amounts, the movable component 230 can be both rotated and translated. Various movements are possible depending on the amount by which, and the direction in which, each of the adjustment mechanisms 130, 140 is adjusted.

To allow the movable component 230 to translate in the w direction shown in FIG. 1B, the width of the first pair of flexures 210 and the second pair of flexures 220 can, in some implementations, be arranged as shown in perspective view in FIG. 2. Such implementations can be used, for example, where the flexures are formed from thin sheets of material. Thin sheets of material can resist deflection in tension, but offer less resistance to deflection in a direction perpendicular to their width. Where the flexures are made of thin sheets of material, the width of the flexures can be arranged perpendicular to the w direction, thus allowing deflection in the w direction.

Alignment of fluid ejection modules 200 can be performed by rotating the first adjustment screw 135, the second adjustment screw 145, or both. Referring again to FIGS. 7A, 7B, and 7C, rotating the second adjustment screw 145 causes rotation of the fluid ejection module 200 around the first bearing axis 710. Similarly, rotating the first adjustment screw 135 can cause rotation of the fluid ejection module 200 around the second bearing access 720. In some implementations, rotating both adjustment screws 135, 145 by a same amount in a same direction can cause translation of the fluid ejection module 200. Rotating both adjustment screws 135, 145 can cause various combinations of rotation and translation of the fluid ejection module 200.

Adjustment of the adjustment screws 135, 145 can be performed during operation of the fluid ejection module 200, and adjustment can be made in light of information gathered regarding the alignment of the fluid ejection module 200. Such alignment information can be gathered during operation of the fluid ejection module 200. For example, sensors, such as optical sensors, can sense where fluid has been ejected from the fluid ejection module or where fluid has contacted a medium, and alignment information can be generated from the output of these optical sensors.

Referring again to FIGS. 5A-5C, the offset e permits a relatively large angular movement of an adjustment screw to be converted into a relatively small displacement of an eccentric bearing 440. This arrangement facilitates precise control of the position of the fluid ejection module 200. The size of the offset e can be selected to achieve a desired range of movement of the eccentric bearing 440 in light of design factors such as manufacturing design tolerances. The manufacturing design tolerances of the various components of the mounting assembly 100, fluid ejection module 200, and frame 110 can be summed to find a total manufacturing design tolerance. The offset e can be selected such that the range of motion of the fluid ejection module 200 is greater than or equal to the total manufacturing design tolerance. In this way, the position of the fluid ejection module 200 can be adjusted to compensate for manufacturing design tolerances. For example, the offset e can be between about 0.5 microns and about 500 microns, such as about 100 microns.

In some implementations, the adjustment screws can be turned by hand. Set screws can be provided to hold the adjustment screws in a fixed position when not adjusting, and the set screws can have a nylon tip. A set screw with a nylon tip can create friction to hold an adjustment screw in place without deforming or otherwise damaging the adjustment screw. In these and other implementations, the adjustment screws can be turned by a motor rather than by hand, and the motor can be controlled, for example, manually or by a computer. Where adjustment of the adjustment screws is performed by motors, stepper motors can be used, and gear reduction can be used to increase the accuracy of adjustment. In some implementations, gear reduction can produce the result that the motor cannot be "back-driven" by forces exerted on the adjustment screw, thus potentially obviating the need for a set screw.

In some implementations, the motors can be stepper motors with a home sensor. In one implementation, a Hall effect sensor is used to determine a home position, e.g., the position of the adjustment screws 135, 145 at which the magnetic field is either the highest or the lowest. A Hall effect sensor measures the strength of a magnetic field. In this implementation, a magnetic disk is affixed to each adjustment screw 135, 145. As the magnetic disk moves nearer the Hall effect sensor, the magnetic field increases, and as the magnetic disk moves away from the Hall effect sensor, the magnetic field decreases. The Hall effect sensor is used to sense the position of the magnetic disk, from which the position of the adjustment screws 135, 145 can be determined.

In one implementation, the Hall effect sensor can be used in conjunction with an encoder on the motor to sense a rotation position. In one example, the encoder pulses 1024 times per revolution of each adjustment screw 135, 145. Each pulse corresponds to four counts, and thus one revolution of each adjustment screw 135, 145 is the equivalent of 4096 counts. The positions of the adjustment screws 135, 145 can be controlled at the level of counts, thereby providing high resolution positioning of the adjustment screws 135, 145, which can result in high resolution alignment of the nozzles 170.

In some implementations, the motors can include a high gear reduction gearbox, for example, a 1000 to 1 gear ratio. In another implementation, one or both of the motors can be a DC motor with a high gear reduction gearbox and an encoder. In other implementations, other suitable motors can be used.

The pairs of flexures 210, 220 can be pre-stressed in some implementations to facilitate consistent accuracy of adjustment and/or alignment. For example, the pairs of flexures 210, 220 can be pre-curved before installation in the mounting assembly 100. When installed, the pairs of flexures 210, 220 can be held in a substantially straight position by the movable component 230, which is in turn held by the eccentric bearing 440 attached to the first adjustment screw 135. The pairs of flexures 210, 220 are thus in a pre-stressed state because they are elastically bent away from their free positions. This pre-stress tends to hold the components of the mounting assembly 100 in a consistent position. Without being confined to any particular theory, this holding effect results from the force of the pre-stress pushing all of the components in the same direction and thereby taking up any looseness between the components of the mounting assembly 100. Again without being confined to any particular theory, the pre-curve can be made sufficiently large that the flexures exert force in the same direction throughout rotation of the adjustment screw 135, thereby facilitating consistency of adjustment throughout rotation.

In some implementations, a mask or template can be used to visually align the fluid ejection module 200 with the frame 110, another fluid ejection module 200, or both. For example, a mask or template can be aligned with the frame 110. Cameras with a suitably sized field of view can be used to view the nozzle face 160 from a perspective similar to the perspective of FIG. 1B, and nozzles or markings on the nozzle face 160 can be aligned with locations on the mask or template.

The use of terminology such as "front," "back," "top," and "bottom" throughout the specification and claims is for illustrative purposes only, to distinguish between various components of the printhead module and other elements described herein. The use of "front," "back," "top," and "bottom" does not imply a particular orientation of the printhead module. Similarly, the use of horizontal and vertical to describe elements throughout the specification is in relation to the implementation described. In other implementations, the same or similar elements can be orientated other than horizontally or vertically as the case may be.

A number of embodiments of the invention have been described. Nevertheless, it will be understood that various modifications may be made without departing from the spirit and scope of the invention. For example, instead of set screws or motors, a friction fit, potentially aided by a spring, can be used to prevent adjustment screws from turning when not being adjusted. Accordingly, other embodiments are within the scope of the following claims.

What is claimed is:

1. A system comprising a mounting assembly to mount a fluid ejection module to a frame having a length in a first direction and a width in a second direction, the mounting assembly comprising:

a fixed component configured to affix to the frame;

a movable component adapted to move relative to the fixed component and the frame;

a first pair of flexures connecting a first end of the fixed component to a first end of the movable component;

a first adjustment mechanism positioned at the first end;

a second pair of flexures connecting a second end of the fixed component to a second end of the movable component;

a second adjustment mechanism positioned at the second end; and a connector configured to couple the mounting assembly to the fluid ejection module such that movement of the movable component imparts corresponding movement to the fluid ejection module;

wherein, the first adjustment mechanism and the second adjustment mechanism are configured to be operated individually to rotate the movable component and to be operated together to translate the movable component in an oblique angular direction relative to the first direction and the second direction.

2. The system of claim 1, wherein a length of each flexure included in the first and second pairs of flexures is identical such that the fixed component and the movable component remain substantially parallel to one another while moving relative to one another.

3. The system of claim 1, wherein the first adjustment mechanism is positioned between the first pair of flexures and the second adjustment mechanism is positioned between the second pair of flexures.

4. The system of claim 1, wherein:

a first edge of the fixed component, a first edge of the movable component and the first pair of flexures together form a parallelogram configuration which configuration is substantially maintained upon movement of the movable component; and a second edge of the fixed component, a second edge of the movable component and the second pair of flexures together also form a parallelogram configuration which configuration is substantially maintained upon movement of the movable component.

5. The system of claim 1, further comprising:

the fluid ejection module having a width in a third direction and including an array of nozzles formed on a nozzle face;

wherein, the first adjustment mechanism and the second adjustment mechanism can be configured to operate individually to rotate a first or second end of the fluid ejection module, respectively, and to operate together to translate the fluid ejection module in the third direction, such that the array of nozzles can be aligned relative to the frame and relative to an array of nozzles included in an adjacent fluid ejection module also mounted to the frame.

6. The system of claim 1, wherein at least one of the first adjustment mechanism and the second adjustment mechanism further comprises an eccentric bearing.

7. The system of claim 6, wherein the eccentric bearing is configured such that operating a corresponding adjustment mechanism causes the eccentric bearing to at least partially orbit an axis through a center of the corresponding adjustment mechanism, the axis being substantially perpendicular to the fixed component.

8. The system of claim 1, further comprising a motor connected to at least one of the first adjustment mechanism and the second adjustment mechanism.

9. The system of claim 8, wherein the motor is connected to one of the first adjustment mechanism or the second adjustment mechanism by reduction gears.

10. The system of claim 1, wherein the mounting assembly further comprises a fluid inlet providing a fluid path through the fixed component and the movable component toward the fluid ejection module.

11. The system of claim 10, wherein the movable component can be moved relative to the fixed component while maintaining a fluid tight path through the mounting assembly to the fluid ejection module.

12. An apparatus comprising:

a frame having a length in a first direction and a width in a second direction; and a mounting assembly configured to mount a fluid ejection module to the frame, the mounting assembly comprising:

a fixed component configured to affix to the frame;

a movable component configured to move relative to the fixed component and the frame;

a first adjustment mechanism positioned along a first axis that is orthogonal to a first surface of the movable component, that is proximate to a first end of the movable component;

a second adjustment mechanism positioned along a second axis that is orthogonal to the first surface of the movable component, that is proximate to a second end of the movable component;

a connector configured to couple the mounting assembly to the fluid ejection module such that movement of the movable component imparts corresponding movement to the fluid ejection module;

wherein the first adjustment mechanism and the second adjustment mechanism are configured to be operated individually to rotate the movable component about the second axis and the first axis respectively and are configured to be operated together to translate the movable component in an oblique angular direction relative to the first direction and the second direction.

13. The system of claim 1, wherein the first adjustment mechanism and the second adjustment mechanism are configured to be operated individually to rotate the movable component about the second axis and the first axis respectively.

14. The apparatus of claim 12, further comprising:

the fluid ejection module having a width in a third direction and including an array of nozzles formed on a nozzle face;

wherein, the first adjustment mechanism and the second adjustment mechanism are configured to operate individually to rotate a first or second end of the fluid ejection module, respectively, and to operate together to translate the fluid ejection module in the third direction, such that the array of nozzles can be aligned relative to the frame and relative to an array of nozzles included in an adjacent fluid ejection module also mounted to the frame.

* * * * *